US005179909A

United States Patent [19]

Sollinger

[11] Patent Number: 5,179,909

[45] Date of Patent: Jan. 19, 1993

[54] DEVICE FOR DOSING COATING SUBSTANCES ON A TRAVELING WEB OF PAPER OR CARDBOARD OR THE LIKE

[75] Inventor: Hans-Peter Sollinger, Heidenheim, Fed. Rep. of Germany

[73] Assignee: J.M. Voith GmbH, Heidenheim, Fed. Rep. of Germany

[21] Appl. No.: 765,150

[22] Filed: Sep. 25, 1991

Related U.S. Application Data

[62] Division of Ser. No. 582,259, Sep. 13, 1990, Pat. No. 5,101,760, which is a division of Ser. No. 385,212, Jul. 25, 1989, Pat. No. 4,980,207.

[30] Foreign Application Priority Data

Jul. 27, 1988 [DE] Fed. Rep. of Germany ..... 3825412

[51] Int. Cl.[5] ..... B05C 11/02

[52] U.S. Cl. ..... 118/119; 15/256.52; 118/262; 118/410; 118/414; 118/419; 492/30

[58] Field of Search ..... 118/117, 119, 262, 410, 118/414, 419; 29/121.4, 121.5; 15/256.52

[56] References Cited

U.S. PATENT DOCUMENTS

| | | | |
|---|---|---|---|
| 1,957,963 | 5/1934 | Johnstone | 29/121.4 |
| 2,066,780 | 1/1937 | Holt | 427/356 |
| 3,718,117 | 2/1973 | Lewicki, Jr. | 118/414 |
| 4,869,933 | 9/1989 | Sollinger et al. | 118/410 |
| 5,103,759 | 4/1992 | Henseler et al. | 118/118 |

*Primary Examiner*—Michael G. Wityshyn
*Attorney, Agent, or Firm*—Baker & Daniels

[57] ABSTRACT

A device for dosing coating substances onto a travelling web. A doctor roll has circumferential grooves which are separated from each other by lands. Each of the lands has a surface parallel to the center axis of the roll when viewed in the direction of the center axis. The respective widths of the lands, viewed in the center axis direction, maximally equal the maximum width of the cross section of the circumferential grooves.

4 Claims, 1 Drawing Sheet

DEVICE FOR DOSING COATING SUBSTANCES ON A TRAVELING WEB OF PAPER OR CARDBOARD OR THE LIKE

This is a division of application Ser. No. 07/582,259, filed Sep. 13, 1990, now U.S. Pat. No. 5,101,760, which is a division of application Ser. No. 07/385,212, filed Jul. 25, 1989, now U.S. Pat. No. 4,980,207.

BACKGROUND OF THE INVENTION

The invention concerns an applicator in which two immediately successive layers are applied on one another while the first layer is still moist, and where for both the first and second coating operations at least one rotatable roll provided which carries the web and where the second coating device features a smoothing scraper. The process for the coating of traveling webs, with two successive coating operations where the layer applied first is still moist as the second layer is applied, is known from U.S. Pat. No. 3,202,536. The two coating stations are arranged both on a single roll carrying the web and on two successive rolls. A similar device is known also from Canadian Patent No. 882 640. The latter differs from the former in that the application in the first coating station occurs by means of an applicator roll. The layer applied first is then made uniform by means of a blade, the excess being scraped off. In the case of the other device, a scraping by means of a scraper blade occurs as well in the first coating station.

SUMMARY OF THE INVENTION

The invention proposes a new coating device having the advantage that the coating is applied first lightly on the web, with a uniform pressing of the first coating quantity into the web taking place due to the press gap between the first web guide roll and the press roll. Thus, the web is quasi impregnated, and it is readily possible to uniformly apply the finish layer with the second coating device. Due to the press gap, no significant stress occurs, specifically no traction or squeezing stress on the web. The scraper blade which easily tends to deform the web or even causes web breaks is avoided. For a uniform application of a dosed amount it is very advantageous to use a rolling blade which is grooved on its circumference. The grooves may be very fine, obtaining a very uniform application.

BRIEF DESCRIPTION OF THE DRAWINGS

The invention will be explained hereafter with the aid of three examples illustrated in the figures of the drawing.

DESCRIPTION OF THE PREFERRED EMBODIMENTS

Figure 1:
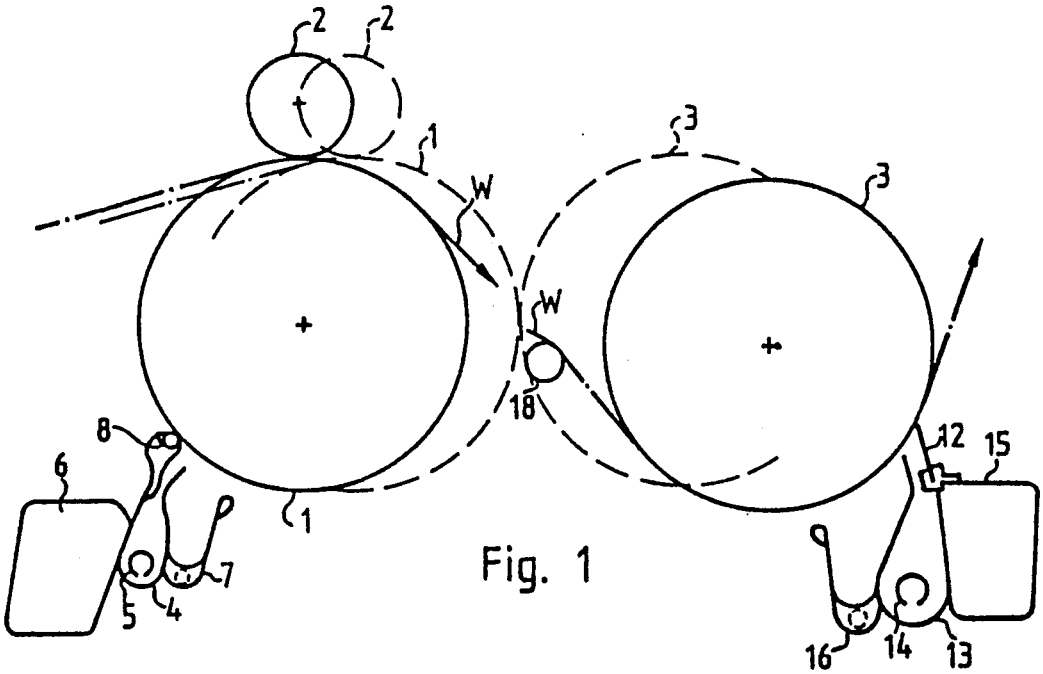
FIG. 1 is an apparatus for coating a paper or board web in accordance with the present invention.

Marked 1, in FIG. 1, is the first web guide roll, i.e., the one of the first coating device, while 2 marks the pertaining press roll and 3 the web guide roll of the second coating device. The threading of the web is marked W. The first coating device features an applicator chamber 4 for the coating substance, with the latter being fed into said chamber through the feed pipe 5. In this case, the applicator chamber is fashioned as a nozzle chamber with an overflow permitting excess coating substance to flow into the collector tub 7 which is attached to the applicator chamber 4. The applicator chamber 4 is held by a support beam 6. Located on the exit end of the applicator chamber 4, in the direction of rotation of the web guide roll 1, is the dosing element, a rolling blade 8 which preferably features a surface that is provided with peripheral grooves. Provided as second coating device is as well such an applicator chamber 13 with feed pipe 14. Also available is a collecting trough 16 and a support beam 15. Instead of the rolling blade 8, a regular coating blade 12 is provided here on the exit end with regard to the applicator chamber 13, which smooths the second application layer. In the press gap forming between the web guide roll 1 and the press roll 2, the relatively accurately dosed coating substance is pressed into the web, preferably a paper or cardboard web, thus impregnating the web. The web W proceeds then without drying to the second coating device. In doing so it can be passed over a spreader roll so as to avoid wrinkling.

Naturally, the coating blade 12 is in either case forced down in customary fashion by the hold down-means, in such a way that it is in uniform contact with the web guide roll 3 respectively the web, smoothing the coating very uniformly.

The applicator mechanisms with applicator chamber are known, for instance from U.S. Pat. No. 4,250,211, and applicator blades with sump and rolling blade including holder from U.S. Pat. No. 2,970,564. A rolling blade provided with a wire wrapping that forms the peripheral grooves is known, e.g., from U.S. Pat. No. 3,387,585.

The lay of the web and the stress on the web can be considerably equalized yet by web traction, with the aid of a spreader roll 18 incorporated between the two web guide rolls 1 and 3.

Illustrated in FIG. 1, by dash-dot line is a variant where the web guide rolls 1 and 3 are arranged immediately side by side. In the gap formed between the two rolls, the web runs relatively free of friction, but at any rate without significant hold-down forces.

Contact pressure in the nip between rolls 1 and 2 is not possible, since the web stretch and cross expansion between the nip of rolls 1 and 2 and the blade 12 cannot be equalized.

The basic principle of the inventional applicator device is performing the first coating only to an extent such that essentially only an impregnation of the paper is taking place. Therefore, the amount of coating substance applied in the first coating device depends on the absorptivity of the paper, which, among others, is essentially a function of the basis weight of the paper. For wood-free grades, for instance, basis weights of not more than 80 $g/m^2$ are used. On these papers, which due to their greater porosity also have a greater absorptivity, the basis weight of coating applied in the first coating device amounts maximally to about 7 $g/m^2$, so that overall a coating quantity of 15 $g/m^2$ is applied in both coating devices. The respective groove size amounts cross-sectionally to maximally about 0.012 $mm/m^2$. This applied essentially to wire-wound roll type blades. However, these blades do not have a long service life.

Figure 2:
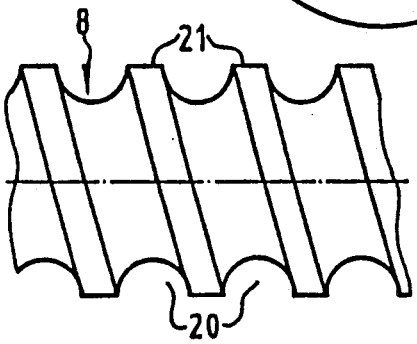
FIG. 2 is a side view of a coating roller of the apparatus of FIG. 1.

Therefore, roll type blades have been developed for the inventional applicator device that make it possible to produce a flawless coating over longer periods of operating time. Such a roll type blade is illustrated in FIG. 2, containing between the grooves 20 lands 21 which in cross-section, viewed parallel to the center axis of the roll type blade, have a surface which is parallel to said center axis.

For the cross-section of these grooves, a value per meter of working widths of the roll type blade of maximally 34 $mm^2$ can be considered as the upper limit.

The circumferential grooves each have a cross section of maximally 0.012 $mm^2$ when the paper has a basis weight of more than 80 $g/m^2$.

In the case of papers of lesser quality, i.e., with a basis weight of less than 80 $g/m^2$, the cross-section of the grooves of a wire-wound roll type blade is maximally about 0.006 $mm^2$ for applying a coating layer of 3 $g/m^2$ by means of the first coating device. The total application amounts then to about 10 $g/m^2$.

Figure 3:
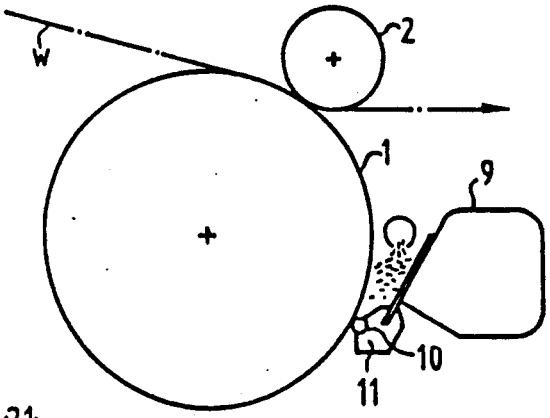
FIG. 3 is an alternative embodiment of an applicator device in accordance with the present invention.

In the arrangement according to FIG. 3, another applicator device is coordinated with the web guide roll 1, on which a holder 11, which together with the support beam 9 forms the sump of coating substance, is provided for the roll type blade 10. Since an open sump is concerned, the required pump capacity is lower here than in the case of FIG. 1.

What is claimed is:

1. A device for dosing coating substances onto a traveling web of paper, cardboard and the like, comprising:

a doctor roll having circumferential grooves which are separated from each other by lands, each of said lands having a surface parallel to the center axis of said roll when viewed in the direction of said center axis, said circumferential grooves having an overall cross-section per meter of working width of said doctor roll of maximally 34 $mm^2$, wherein the respective widths of said lands, viewed in said center axis direction, maximally equals the maximum width of the cross section of the circumferential grooves.

2. The device of claim 1, wherein said coating substances are utilized to coat a traveling paper web having a basis weight of more than 80 $g/m^2$ or a basis weight of maximally 80 $g/m^2$, wherein said circumferential grooves each have a cross section of maximally 0.012 $mm^2$ when said paper has a basis weight of more than 80 $g/m^2$, and a cross section of maximally 0.006 $mm^2$ when said paper has a basis weight of maximally 80 $g/m^2$.

3. In a device for dosing coating substances onto a traveling web of paper, cardboard and the like, an improved doctor roll for dosing said coating substances, said doctor roll comprising a roll member having a plurality of circumferential grooves, said circumferential grooves being separated from each other by lands, each of said lands having a surface parallel to the center axis of said roll member when viewed in the direction of said center axis, said circumferential grooves having an overall cross-section per meter of working width of said doctor roll of maximally 34 $mm^2$, wherein the respective widths of said lands, viewed in said center axis direction, maximally equals the maximum width of the cross section of the circumferential grooves.

4. In a device for dosing coating substance onto a traveling web of paper, cardboard and the like, of the type wherein the traveling web is guided through the device by guide rolls, an improved doctor roll for dosing said coating substances onto the traveling web, said doctor roll comprising a roll member having a plurality of circumferential grooves, said circumferential grooves being separated from each other by lands, each of said lands having a surface parallel to the center axis of said roll member when viewed in the direction of said center axis, wherein the respective widths of said lands, viewed in said center axis direction, maximally equals the maximum width of the cross section of the circumferential grooves, and wherein said coating substances are utilized to coat a traveling paper web having a basis weight of more than 80 $g/m^2$ or a basis weight of maximally 80 $g/m^2$, said circumferential grooves each having a cross section of maximally 0.012 $mm^2$ when said paper has a basis weight of more than 80 $g/m^2$, and a cross section of maximally 0.006 $mm^2$ when said paper has a basis weight of maximally 80 $g/m^2$.

* * * * *